US011189448B2

(12) United States Patent
Schaper

(10) Patent No.: US 11,189,448 B2
(45) Date of Patent: Nov. 30, 2021

(54) RELAY WITH A CONTROLLER

(71) Applicant: Phoenix Contact GmbH & Co. KG, Blomberg (DE)

(72) Inventor: Elmar Schaper, Lügde (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 214 days.

(21) Appl. No.: 15/702,284

(22) Filed: Sep. 12, 2017

(65) Prior Publication Data

US 2018/0075992 A1 Mar. 15, 2018

(30) Foreign Application Priority Data

Sep. 14, 2016 (DE) ..... 10 2016 117 273.1

(51) Int. Cl.
*H01H 47/18* (2006.01)
*H01H 47/00* (2006.01)

(52) U.S. Cl.
CPC ..... *H01H 47/18* (2013.01); *H01H 47/002* (2013.01)

(58) Field of Classification Search
CPC ..... H01H 33/006; H01H 3/00; H01H 47/18; H01H 47/002
USPC ..... 307/125
See application file for complete search history.

(56) References Cited

U.S. PATENT DOCUMENTS 4,356,525 A * 10/1982 Kornrumpf ..... H02H 9/002 361/4
5,064,998 A * 11/1991 Holling ..... H01H 9/50 219/519
5,640,113 A * 6/1997 Hu ..... H01H 9/56 327/141
5,714,847 A * 2/1998 Lindauer ..... H05B 39/048 315/307
9,425,011 B2 * 8/2016 Creighton ..... H01H 47/002
2003/0235017 A1 * 12/2003 Liu ..... H01H 9/56 361/2
2011/0141647 A1 * 6/2011 Garcia ..... H01H 23/145 361/166
2013/0286528 A1 * 10/2013 Murfett ..... H01H 9/56 361/195
2015/0098164 A1 * 4/2015 Lenig ..... H01H 9/56 361/185
2018/0130618 A1 * 5/2018 Ramirez ..... H01H 9/56

FOREIGN PATENT DOCUMENTS

| | | | |
|---|---|---|---|
| CN | 101111912 | A | 1/2008 |
| CN | 101789334 | A | 7/2010 |
| CN | 102419562 | A | 4/2012 |
| CN | 204242953 | U | 4/2015 |
| DE | 10 2005 005 228 | A1 | 8/2006 |
| DE | 10 2005 051 762 | A1 | 5/2007 |
| DE | 10 2009 043 553 | A1 | 3/2011 |

* cited by examiner

*Primary Examiner* — Hal Kaplan
*Assistant Examiner* — Swarna N Chowdhuri
(74) *Attorney, Agent, or Firm* — Holland & Hart LLP

(57) ABSTRACT

The disclosure relates to a relay having a controllable relay contact, having an electrical connection terminal where an electrical variable is able to be tapped, a control connection for receiving a control signal for actuating the relay contact, and a controller, configured, in response to the reception of the control signal, to detect a zero crossing of the electrical variable and to actuate the controllable relay contact in a time-delayed manner after the zero crossing of the electrical variable.

17 Claims, 8 Drawing Sheets

RELAY WITH A CONTROLLER

CROSS-REFERENCE TO RELATED APPLICATION

This application claims priority to German patent application No. 10 2016 117 273.1, entitled "Relais mit einer Steuerung", and filed on Sep. 14, 2016 by the Applicant of this application. The entire disclosure of the German application is incorporated herein by reference for all purposes.

BACKGROUND

The present disclosure relates to an electromechanical relay having a controller.

Different types of relays are used in various applications. Typical applications in the industrial field are the driving of electrical loads, which may be ohmic, inductive or capacitive consumers.

Since a relay is an electromechanical component, the relay exhibits mechanical behaviour during operation. It is therefore possible, when the relay is activated, for the contacts of the relay to bounce or chatter temporarily before the contacts finally arrive in the end position. Furthermore, there is the risk of large electrical or magnetic fields during the period of contact bounce, particularly when a contact is closed at the voltage maximum or opened at the current maximum, which can additionally lead to the generation of an undesired arc when a contact is open.

When the arc has sufficiently high energy, the arc can damage the contacts in the relay. Furthermore, the arc can weld the contacts to one another as a result of heat generation.

It is therefore the object of the present disclosure to provide an improved relay.

SUMMARY

This object is achieved by the features of the independent claims. Advantageous examples of the disclosure are the subject matter of the dependent claims, the description and the accompanying figures.

In accordance with a first aspect, the disclosure relates to a relay having a controllable relay contact, having an electrical connection terminal, at which an electrical variable can be tapped, a control connection for receiving a control signal for actuating the relay contact, and a controller, which is configured, in response to the reception of the control signal, to detect a zero crossing of the electrical variable and to actuate the controllable relay contact in a time-delayed manner after the zero crossing of the electrical variable.

If the electrical variable is the supply voltage, for example, the time-delayed actuation of the controllable contact reduces the probability of actuating the controllable contact, for example, at a peak value of a current through the relay. If the load is a purely inductive load with a phase delay of 90°, for example, a peak value of the current through the relay is expected at a zero crossing of the supply voltage. By preventing the actuation of the relay at zero crossings of the supply voltage, the controllable relay contact is subjected to less electrical loading, which can lead to an increase in the lifetime of the relay.

In one example, the controller is configured to actuate the controllable relay contact before a further zero crossing of the electrical variable.

In one example, the controller is configured to determine or select the time delay for the actuation of the relay contact depending on a load behaviour, in particular depending on an inductive or a capacitive load behaviour, of an electrical load that can be connected to a load connection of the relay.

In one example, the controller is configured to determine the load behaviour of the electrical load or to read it out from a memory. The load behaviour may be capacitive or inductive.

In one example, the load behaviour can be manually input by a user. To this end, the relay can have an interface, by means of which the load behaviour can be input and stored.

In one example, the controller is configured to determine the time delay further depending on a reaction delay of the relay or to drive the controllable relay contact after a drive delay has expired, wherein the drive delay and the reaction delay account for the time delay, or wherein the reaction delay is fixedly predefined and the drive delay corresponds to the time delay, or wherein the time delay comprises the drive delay and the reaction delay.

In one example, the controller is configured to actuate the controllable relay contact in a time-delayed manner after a predetermined time interval has expired after the zero crossing of the electrical variable or at a predetermined time after the zero crossing of the electrical variable or at a predetermined phase angle of the electrical variable after the zero crossing.

In one example, the controller is configured to actuate the controllable relay contact in a load-dependent manner on a rising edge of the electrical variable, on a falling edge of the electrical variable or at a peak value of the electrical variable.

In one example, the controller is configured to identify an edge of the control signal, to determine the zero crossing in response to the identified edge and to actuate the controllable relay contact according to the identified edge of the control signal.

In one example, the controller is configured to identify a rising edge of the control signal and to close the controllable relay contact in a time-delayed manner in response to the identified rising edge in a switch-on operation.

In one example, the controller is configured to identify a Palling edge of the control signal and to open the controllable relay contact in a time-delayed manner in response to the identified falling edge in a switch-off operation.

In one example, the controller is configured, in a switch-off operation of the relay, to detect an arc voltage across the open controllable relay contact and, when an arc voltage is detected, to close the controllable relay contact.

In one example, the controller is configured to close the relay contact on a rising edge of the electrical variable and to open it again on a falling edge of the electrical variable, in order to keep the controllable relay contact closed at a peak value of the electrical variable.

In one example, the controller is configured to monitor an edge profile of the electrical variable or to detect the zero crossings of the electrical variable. Here, rising and/or falling edges of the electrical variable can be sampled electrically.

In one example, the electrical connection terminal is an energy supply connection of the relay, wherein the electrical variable is the supply voltage, or wherein the electrical variable is a supply voltage in a switch-on operation and is a current through the relay in a switch-off operation.

The supply voltage can be the voltage across the relay, the voltage across the electrical load or the voltage across the electrical contact.

The electric current can be a current through the relay, in particular a current through the electrical contact or through the electrical load.

In accordance with a second aspect, the disclosure relates to a method for controlling a relay having a controllable relay contact, with: tapping an electrical variable at an electrical connection terminal of the relay; receiving a control signal for actuating the relay contact at a control connection of the relay; detecting a zero crossing, of the electrical variable in response to the reception of the control signal; and actuating the controllable relay contact in a time-delayed manner after the zero crossing of the electrical variable.

In one example, the method can be carried out by means of the relay in accordance with the first aspect of the disclosure.

Further features of the method can be gathered from the features of the relay in accordance with the first aspect of the disclosure.

BRIEF DESCRIPTION OF THE DRAWINGS

Examples of the present disclosure are explained with reference to the accompanying figures.

DETAILED DESCRIPTION OF THE DRAWINGS

Figure 1:
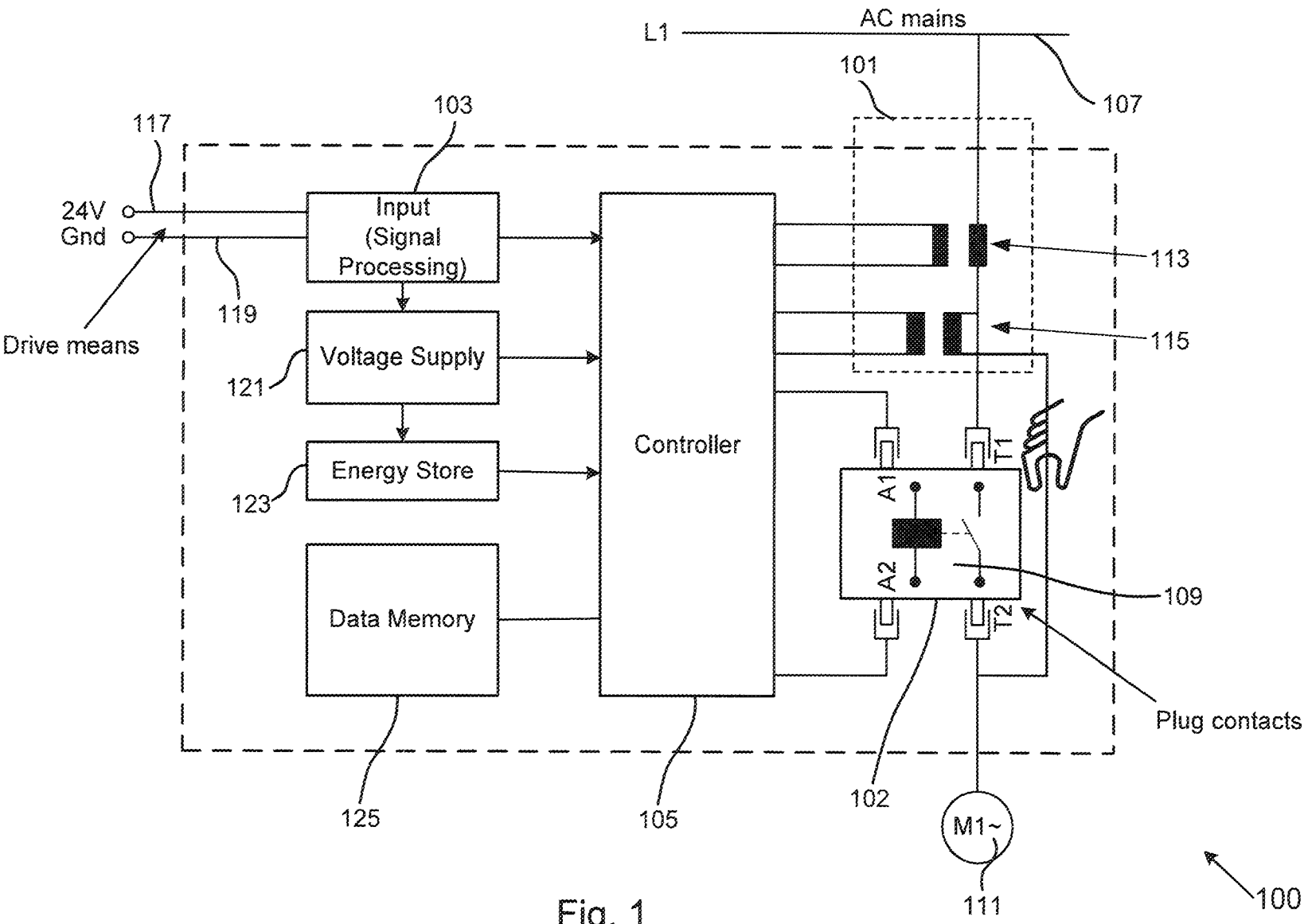
FIG. 1 shows a relay in accordance with one example.

FIG. 1 shows a relay 100 having a controllable relay contact 102, having an electrical connection terminal 101, at which an electrical variable can be tapped, a control connection 103 for receiving a control signal for actuating the relay contact, and a controller 105, which is configured, in response to the reception of the control signal, to detect a zero crossing of the electrical variable and to actuate the controllable relay contact 102 in a time-delayed manner after the zero crossing of the electrical variable.

The electrical connection terminal 101 can be connectable to a voltage supply system 107, at which the supply voltage for the relay 100 can be tapped.

The controllable relay contact 102 has control inputs A1 and A2, to which a control signal can be applied by the controller 105 in order to drive the relay contact 102. The controllable relay contact 102 further has a controllable switch 109, which electrically connects or isolates the connections T1 and T2.

The mains supply-side connection T1 can be connected to the voltage supply system 107. The load-dependent connection T2, however, can be connected to an electrical load 111 for example an electric motor.

The electrical connection terminal 101 can further have an optional current transformer 113, which converts a current through the relay 100 for the controller 105. The controller 105 can be designed for relatively low current amplitudes in this way.

The electrical connection terminal 101 can further have an optional voltage converter 115, which taps the supply voltage across the electrical contact 102 and converts it for the controller 105. The voltage converter 115 taps the supply voltage at the contacts T1 and T2, for example. The voltage converter can also tap the supply voltage across the electrical load.

The control connection 103 has two input contacts 117 and 119, to which a voltage signal, for example 24 V, and a reference potential, fir example ground, can be applied in order to drive the relay 100.

The relay 100 can optionally have a voltage supply 121, which can process the voltage signal at the control connection 103. The processing can be filtering or decision-making regarding voltage levels, for example by means of one or more threshold values.

The relay 100 can optionally have an energy store 123, for example a capacitor, which is connected downstream of the voltage supply 121.

The relay 100 can further have an optional data memory 125, in which the data for the controller 105 can be stored.

In one example, the time delay in the actuation of the relay contact 102 can be the mechanical and/or electrical switching delays of the relay 100. Mechanical relays like the relay 100 can be subjected to different switching times. These switching, times are, for example, dependent on various parameters, such as temperature, manufacturing tolerances, mechanical wear in relays with conditional stiffness, for example. An "additional time" is therefore additionally advantageous in the case of synchronous switching, said "additional time" being taken into account when the time delay is determined.

A further problem that may occur in connection with a relay is the arc burning duration. In relatively small relays, for example with a width of 6 mm, the contact spacings are less than 0.5 mm with respect to one another. If the moment of switching is not precisely at the current zero crossing but slightly thereafter on account of tolerances, the current can no longer be interrupted for the half-period. The arc is then present for approximately 10 ms at 50 Hz and leads to increased thermal loading.

By way of example, the arc voltage (measured) is 25 V at a switching current of 10 A and a power loss at the relay contact of 250 W.

The load type with its specific current characteristics has an influence on the lifetime of the contact. It is therefore advantageous to have precise knowledge thereof.

The most common load types are listed below with their corresponding IE (switch-on current) to IN (continuous current).

Figure 2:
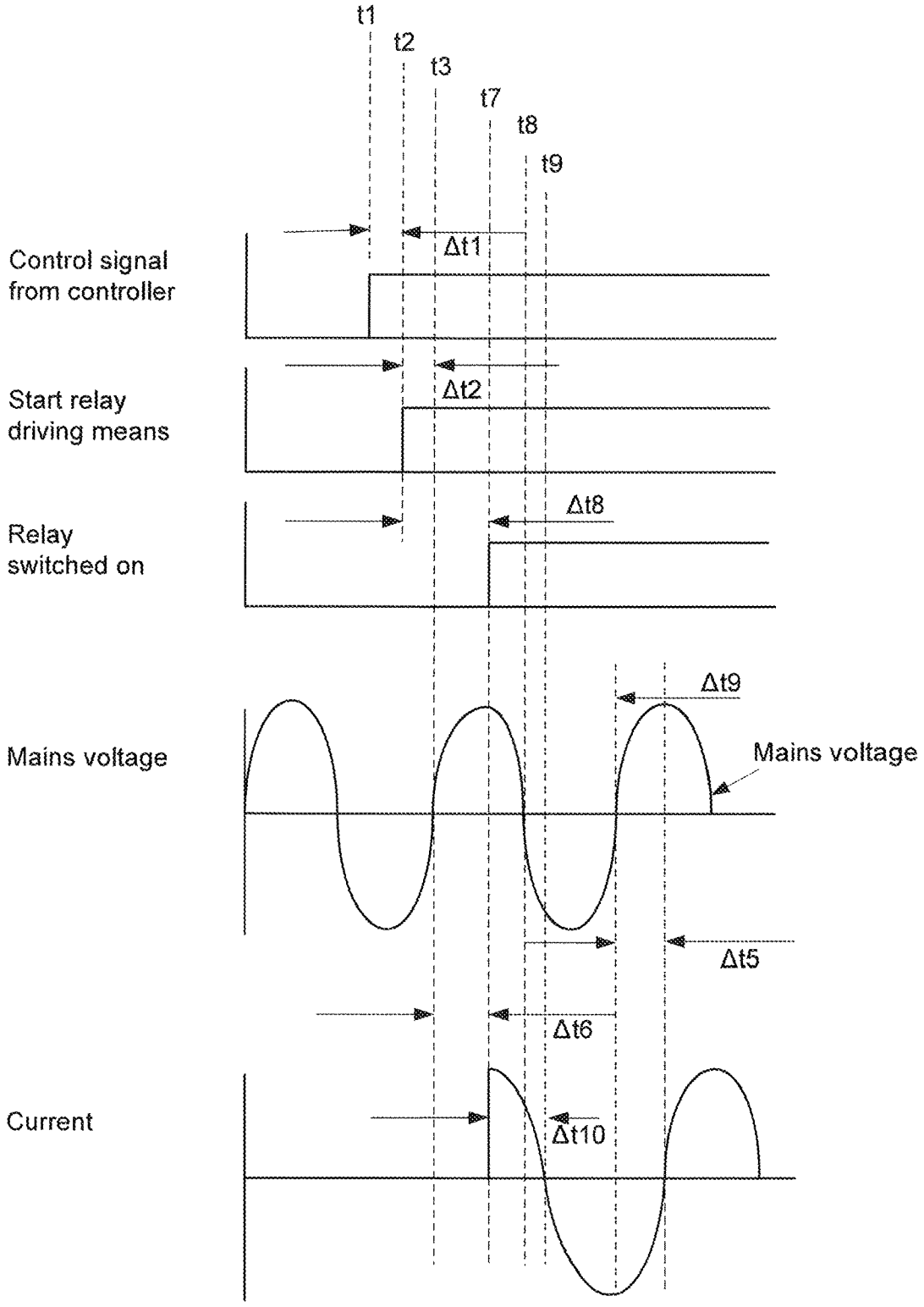
FIG. 2 shows a timing diagram of a switch-on operation.
Figure 3:
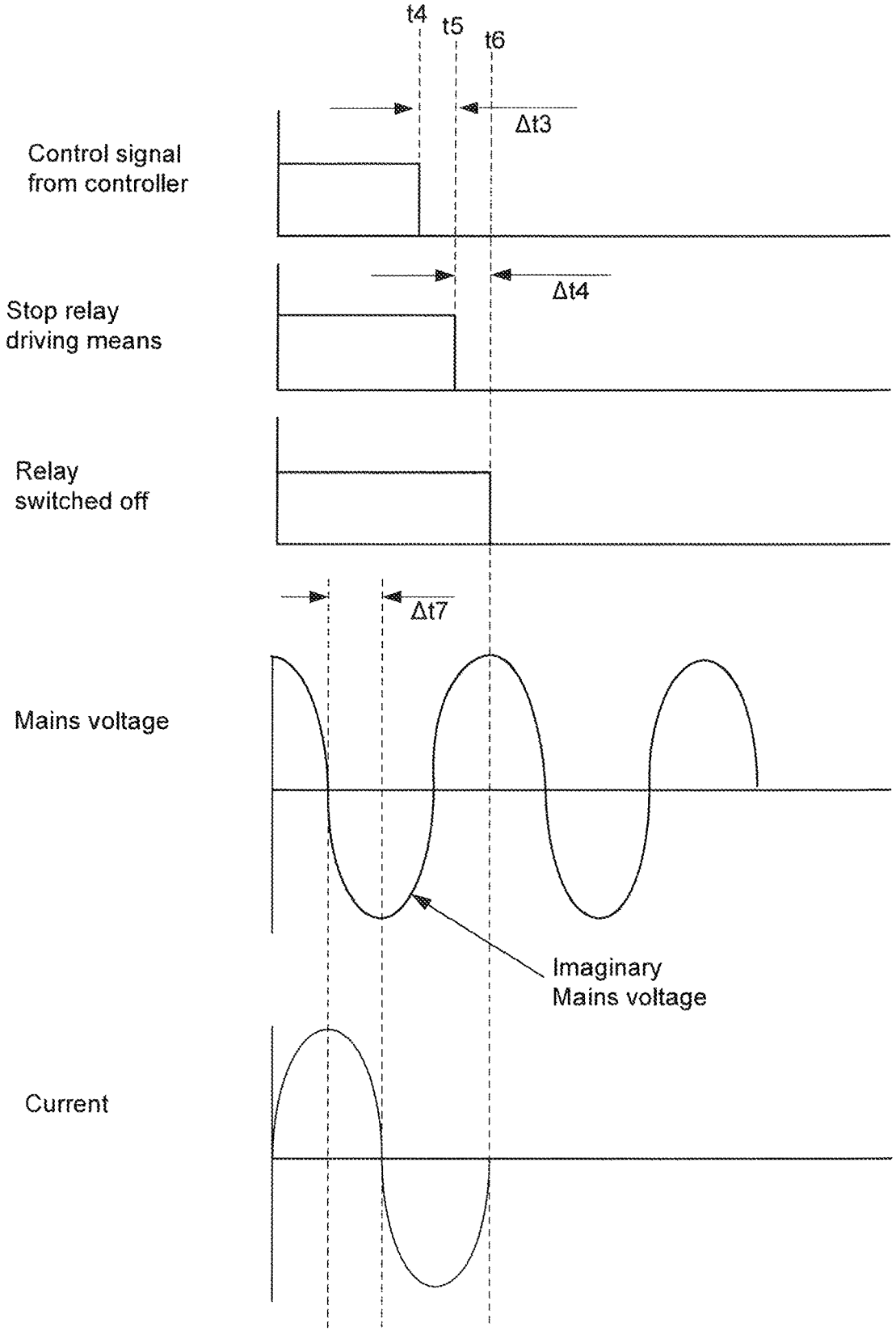
FIG. 3 shows a timing diagram of an ideal switch-off operation.
Figure 4:
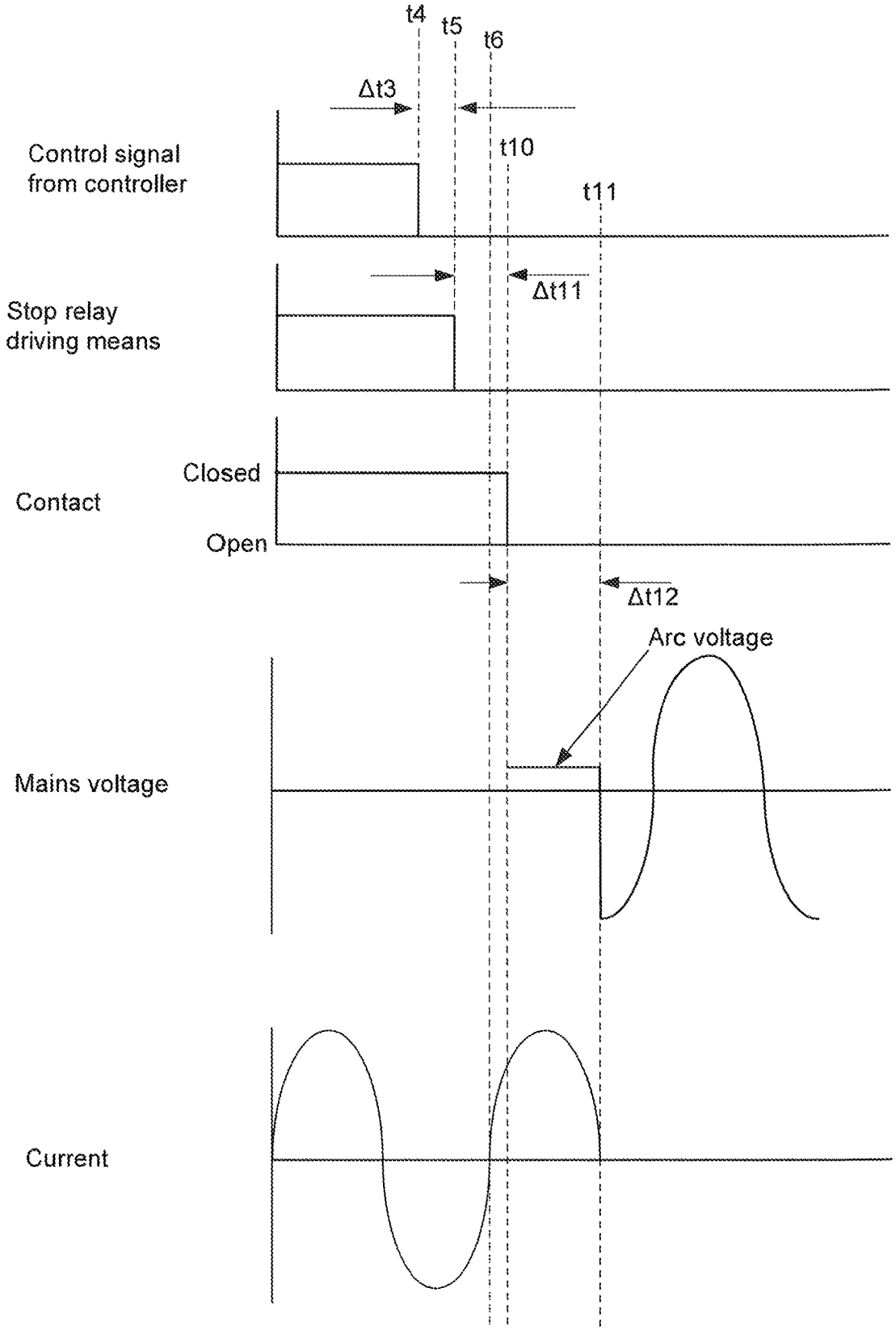
FIG. 4 shows a timing diagram of a disadvantageous switch-off operation.

1. Ohmic load>IE=IN
2. Lamp load>20-40×IN
3. Motor load>6-10×IN
4. Solenoid valves>10-20×IN
5. Capacitors>20-40×IN FIG. 2 illustrates time profiles of the electrical variables during a switch-on operation and FIG. 3 illustrates time profiles of the electrical variables during a switch-off operation. FIG. 4 also illustrates time profiles with an exemplary arc voltage.

The following variables are illustrated in FIGS. 2 to 4:

t1 Start of control signal
t2 Relay driving means on
t3 Mains voltage zero
t4 Stop control signal
t5 Relay driving means off
t6 Relay contact opened
t7 Relay contact closed
t8 Voltage is zero
t9 Current is zero Δt1 Switch-on delay of the relay 100, induced by the system 100

Δt2 Zero voltage delay

Δt3 Switch-off delay of relay 100

Δt5 Phase angle (cos phi) during switch-on

Δt6 Load-dependent delay

Δt7 Phase angle (cos phi) during switch-on

Δt8 Time delay, switching delay: switching time of the relay 100+load dependency Δt9 Mains frequency Δt10 Premagnetization of an inductive load Δt11 Time delay, switch-off delay with onset of arc time Δt12 Arc time In accordance with FIG. 2, during the switch-on operation, the control signal is first received by the relay. The relay driving means is then started with a time delay, whereupon the relay is switched on using the relay driving means shown in the diagram (relay contact closed). The rising edges of the signals are detected here.

The profiles of the mains voltage and of the associated current are illustrated underneath the signal profiles.

In accordance with FIG. 3, during the switch-off operation, the relay driving means is interrupted (stopped) on the falling edge of the controller of the relay 100, whereupon the relay is switched off with the time delay (relay contact open).

In the example illustrated in FIG. 3, the switch-off operation takes place without an arc, for example.

In the example illustrated in FIG. 4, an arc voltage is, generated at the time when the relay contact opens.

In one example, to determine the time delay, the phase positions of the voltage and current zero crossings are identified. As a result, the switch-on point or the time at which the relay contact 102 is actuated can be selected with respect to the mains voltage in such a way that the relay contact 102 is subjected to the least possible loading.

During switch-on, the relay 100 can be synchronized with the voltage zero crossing by a dynamic time offset Δt2. Depending on the load, a further delay Δt6 is advantageous.

In the case of an inductive load, the first switch-on moment can be at 90° to 145° in automatic mode. This is advantageous with respect to loading of the contacts.

The load type can be identified by scanning the phase angle, for example at the connection terminal 101, and the calculation of the switch-on time, that is to say actuating switching point, can be adjusted for all further switching actions.

Alternatively, a corresponding delay and therefore the suitable consumer can be set by means of a manual load type switch, which in one example forms a user interface.

Exemplary actuation times and time delays at a mains frequency of 50 Hz and a period length of 20 ms are specified in the text below:

In the case of lamps and with capacitor loads, t3=0 ms, which corresponds to a phase angle (cos phi) of 0°. In the case of an inductive load, t7=5-8 ms, which corresponds to a phase angle (cos phi) of 90° to 145°.

The time offset Δt8 mirrors the switching time of the relay 100, the load type and an additional time as explained above.

In accordance with one example, the calculated actuation time and the time delay contain all or some tolerances and an additional time, in order that the current zero crossing is not quite reached yet.

During operation, it is advantageous to determine the phase angle (cos phi) constantly or continuously when the load is switched on. This time offset Δt5/Δt7 can also be taken into account in the case of disconnection. The relay 100 is switched off independently of the load type, advantageously always at the current zero crossing. As a result, the contacts are subjected to smooth loading.

Based on an exemplary switch-off delay at the relay 100 of approximately 4-6 ms, the drive voltage is not withdrawn in a time-delayed manner until the next half-period, for example.

In one example, the energy store 123 allows the relay 100 to be disconnected in a sequential manner, that is to say allows the relay contact 102 to be opened at the time at which the supply voltage has already been disconnected.

In one example, varying switching times of the relay 100 can be compensated by a regulating process.

In one example, in contrast to a thyristor, which is switched off automatically when the holding current is undershot or at the current zero crossing, the mains voltage is measured across the relay contact 102 and hence the arc voltage is measured when the relay contact 102 is opened. If this results in a prolonged arc voltage, the current zero crossing is immediately passed through at the disconnection time, that is to say at the time when the relay contact 102 is opened. Based on this, some of the following reaction possibilities arise:

In one example, the determined disconnection time or the time delay is shortened or adjusted for the next switching time.

In one example, the contact 102 is relieved of load by way of a recloser and the calculated disconnection time is adjusted for the next possible current zero crossing and then disconnected.

In one example, the disconnection sequence can be stored, for example in the data memory 125.

In one example, at the disconnection time, in the case of an inductive load (for example transformer load), a remanence is left behind in the iron core of a coil. The direction of this magnetic field is dependent on the current direction in the last half wave. In order to keep the switch-on current as low as possible when the relay 100 is switched on again, it is possible to consider a correspondingly inverse current direction in the first half wave.

In one example, the design according to the disclosure does not produce any contact sparking or produces minimal contact sparking when the relay 100 is switched on and/or off. Moreover, EMV emissions can be reduced. Furthermore, loading of the contacts can be reduced. The temperature can be reduced at the relay contact 102. The relay contact 102 can therefore have a longer lifetime. Moreover, current peaks when the relay contact 102 is switched on and off can be reduced. Furthermore, the loads, for example lamp loads with a cold resistor, are protected by switching the relay contact 102 in a time-delayed manner.

Figure 5A:
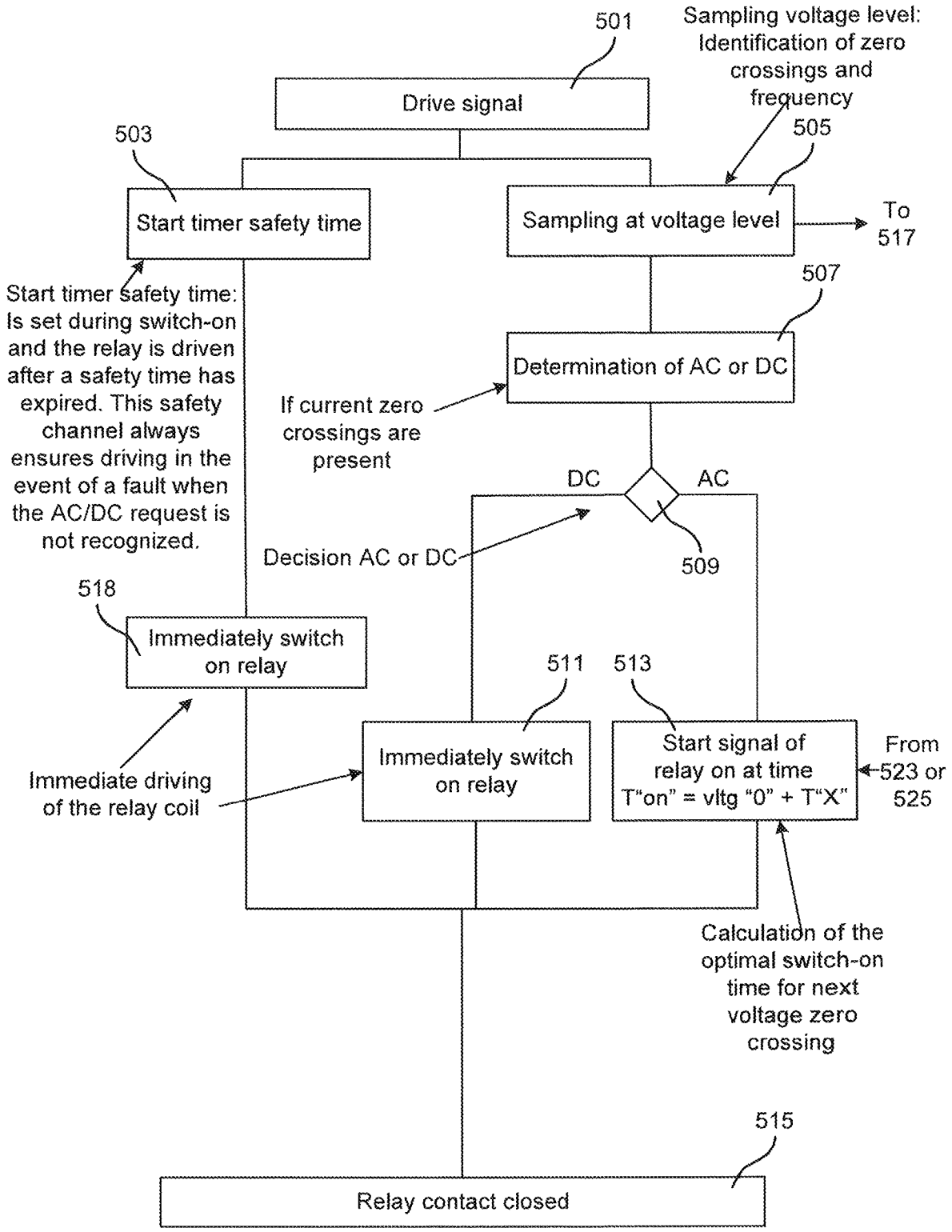
FIGS. 5A and 5B show a flowchart of a switch-on operation.
Figure 5B:
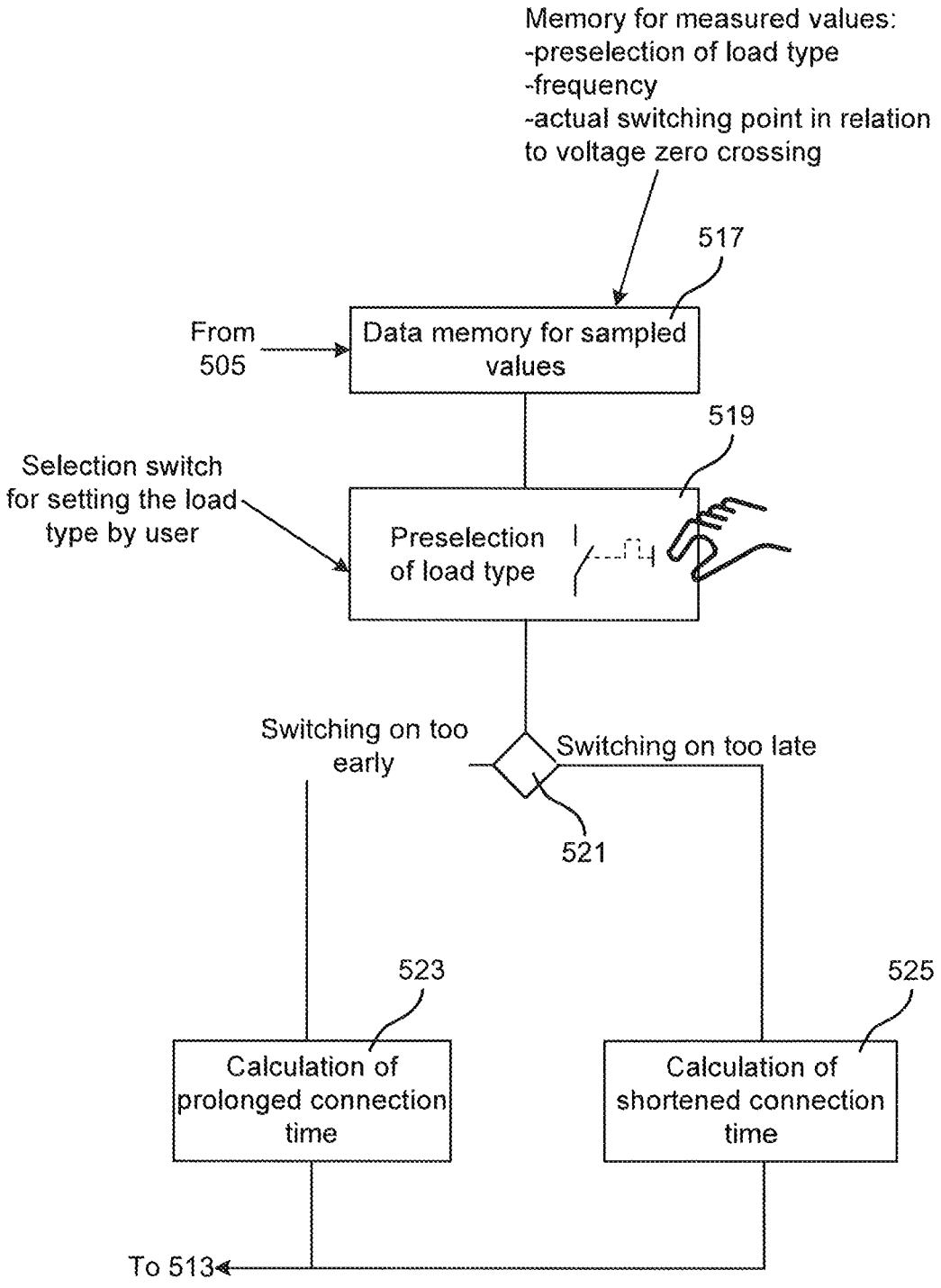

FIGS. 5A and 5B show an exemplary flowchart of a switch-on operation in accordance with one example.

In response to the reception 501 of the drive signal, a timer for determining the additional time (safety time or safety reserve) is triggered 503 and/or a voltage level of the supply voltage is sampled 505. In this case, the zero crossings as well as the frequency of the supply voltage can be identified.

After the voltage level has been sampled 505, current zero crossings are determined or identified 507, wherein an alternating current (AC) or a direct current (DC) are determined. Then, the decision 509 is made as to whether, in the case of the direct current, the immediate switching on 511 of the relay 100 (closing the relay contact 102) can be initiated or whether, in the case of an alternating current, a time-delayed switching on 513 of the relay 100 should be initiated. The switch-on operation then ends with the closing 515 of the relay contact 102.

Proceeding from the triggering 503 of the timer, the relay 100 is immediately switched on 518, wherein a relay coil is driven, for example. Proceeding from the immediate switching on 518, the switch-on operation ends with the closing 515 of the relay contact 102.

The timer can be set when the relay 100 is switched on and the relay 100 or the relay contact 102 can be driven after the additional time (safety time) has expired. In this way, a safety channel is established, which leads into a drive means of the relay 100 or the relay contact 102 in the event of a fault when the AC/DC request is not recognized.

In one example, proceeding from the sampling 505, a memory request 517 can be carried out, in which the data memory 125 is addressed. Measured values, preselections of the time delays for load types, frequencies and/or actual switching times and/or actual actuating times of the relay contact 102 in relation to a current and voltage zero crossing can be stored in the data memory.

After the memory request 517, a preselection 519 of the load type can be performed, for example manually by a user. Here, an inductive, capacitive or ohmic load type can be set.

After checking 521 the time at which the relay 100 is switched on, when the switching on is too early, a prolonged disconnection time or switch-on time of the relay 100 is calculated 523. When the switching on of the relay is too late, a shortened disconnection time or switch-on time is calculated 525.

After the respective calculation 523, 525, the method with the switching on 513 of the relay 100 is continued.

Figure 6A:
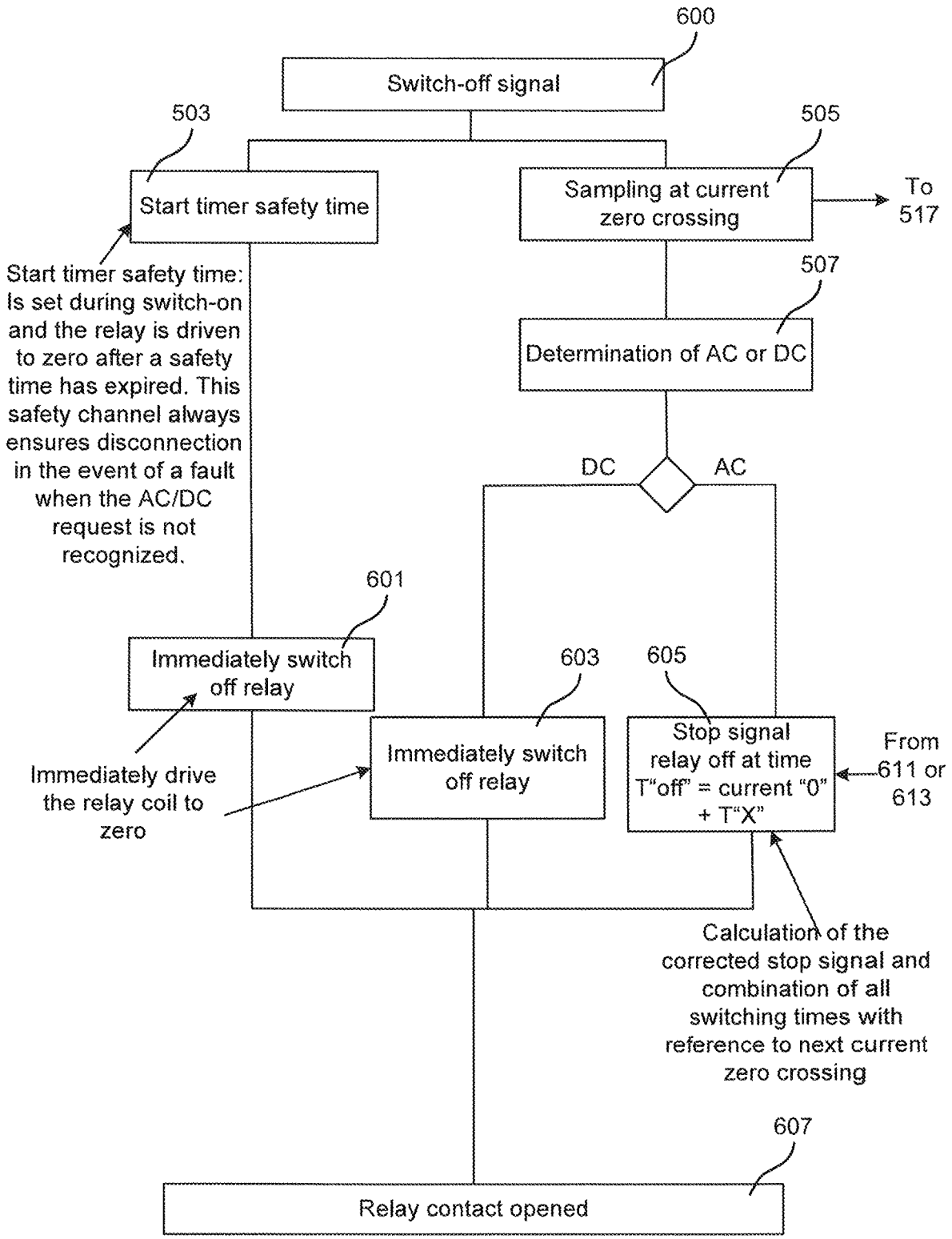
FIGS. 6A and 6B show a flowchart of a switch-off operation.
Figure 6B:
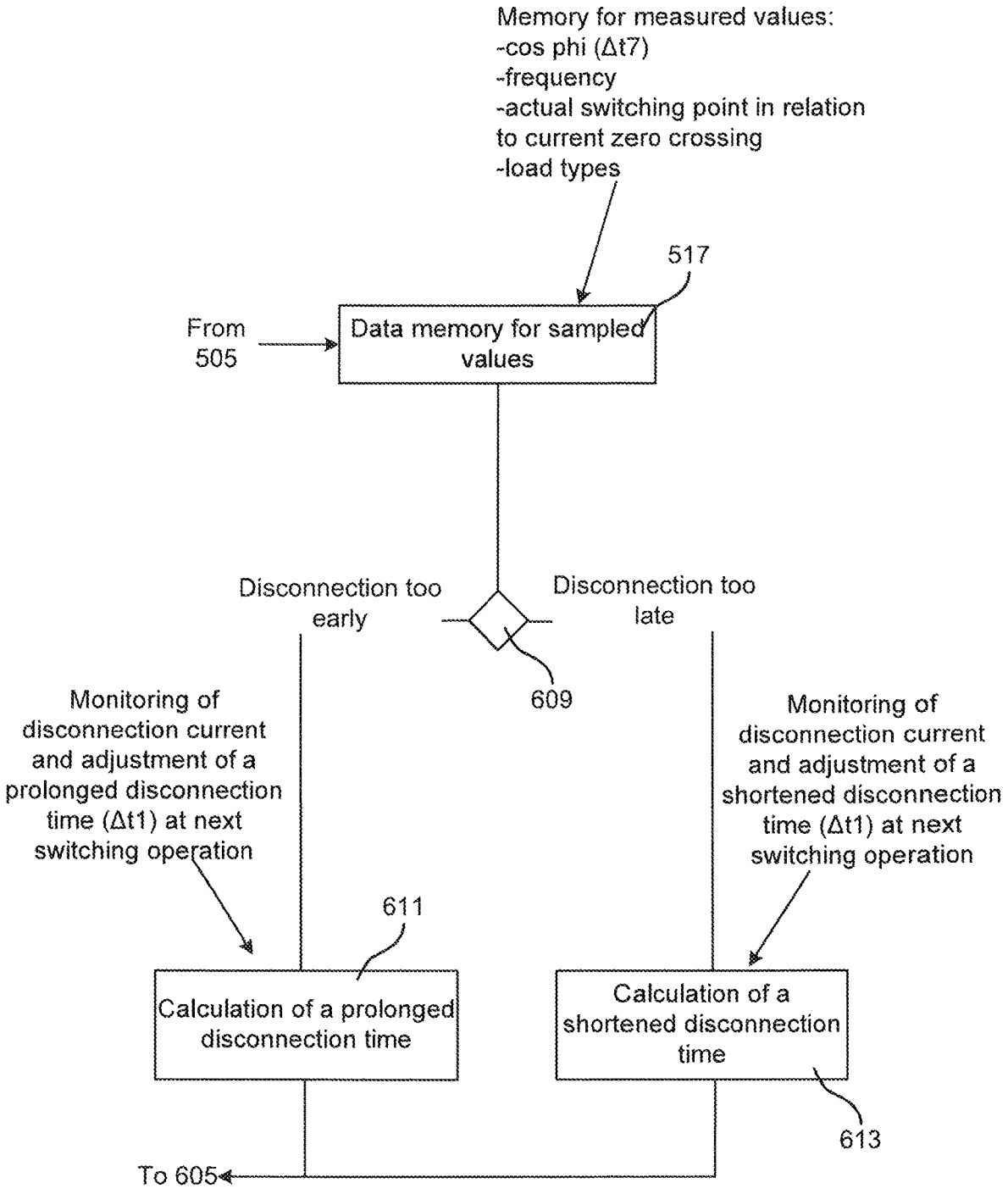

FIGS. 6A and 6B illustrate an exemplary diagram of a disconnection operation of the relay 100.

In contrast to the flowchart of the switch-on operation illustrated in FIG. 5, in the disconnection operation illustrated by way of example in FIG. 6, after the timer is triggered 503 from a switch-off signal 600, the (for example immediate) switching off 601 of the relay 100 is triggered by opening the relay contact 102, for example.

In further contrast to the flowchart of the switch-on operation illustrated in FIG. 5, in the disconnection operation illustrated by way of example in FIG. 6, after the decision 509 in the case of direct current (DC), the (for example immediate) switching off 603 of the relay 100 is triggered by opening the relay contact 102, for example.

In further contrast to the flowchart of the switch-on operation illustrated in FIG. 5, in the disconnection operation illustrated by way of example in FIG. 6, after the decision 509 in the case of alternating current (AC), the time-delayed switching off 605 of the relay 100 is initiated by opening or initiating the opening of the relay contact 102, for example.

Steps 601, 603 or 605 end in the opening 607 of the relay contact 102.

In further contrast to the flowchart of the switch-on operation illustrated in FIG. 5, in the disconnection operation illustrated by way of example in FIG. 6, after the memory request 517, the time of the disconnection of the relay 100 is checked 609 and, when the disconnection is too early, a prolonged disconnection time of the relay 100 is calculated 611. When the disconnection of the relay is too late, a shortened disconnection time is calculated 613. Steps 611 and 613 end in step 605.

What is claimed is:

1. A relay having a controllable relay contact, comprising:

an electrical connection terminal configured to tap an electrical variable;

a control connection configured to receive a control signal for actuating the controllable relay contact; and a controller, configured, in response to the reception of the control signal, to detect a zero crossing of the electrical variable and to actuate the controllable relay contact in a time-delayed manner after the zero crossing of the electrical variable;

wherein the controller is configured to perform one or more of: determining a load behaviour of an electrical load or reading out from a memory the load behaviour of the electrical load, and wherein the controller is configured to determine a time delay for actuating the controllable relay contact based at least in part on the load behaviour of the electrical load;

wherein the controller is configured to actuate the controllable relay contact in a load-dependent manner on a rising edge of the electrical variable, on a falling edge of the electrical variable, or at a peak value of the electrical variable;

wherein the load behaviour of the electrical load is determined by a type of the electrical load and specific current characteristics of the electrical load, wherein the type of the electrical load is one of: an ohmic load type, a lamp load type, a motor load type, a solenoid valves load type, or a capacitors load type, and wherein the specific current characteristics are determined from a ratio of switch-on current to continuous current associated with the corresponding type of the electrical load, wherein the controller is configured, in a switch-off operation of the relay, to detect an arc voltage across the controllable rely contact in an open state and, when the arc voltage is detected, to close the controllable relay contact in the switch-off operation of the relay.

2. The relay according to claim 1, wherein the controller is configured to actuate the controllable relay contact before a further zero crossing of the electrical variable.

3. The relay according to claim 1, wherein the load behaviour is one of an inductive or a capacitive load behaviour, of the electrical load, and wherein the electrical load is connected to a load connection of the relay.

4. The relay according to claim 1, wherein the load behavior is manually input by a user.

5. The relay according to claim 1, wherein the controller is configured to determine the time delay based at least in part on a reaction delay of the relay or to drive the controllable relay contact after a drive delay has expired.

6. The relay according to claim 5, wherein the reaction delay is fixedly predefined and the drive delay corresponds to the time delay.

7. The relay according to claim 1, wherein the controller is configured to actuate the controllable relay contact in the time-delayed manner after a predetermined time interval has expired after the zero crossing of the electrical variable.

8. The relay according to claim 1, wherein the controller is configured to identify an edge of the control signal, to determine the zero crossing in response to the identified edge and to actuate the controllable relay contact according to the identified edge of the control signal.

9. The relay according to claim 1, wherein the controller is configured to identify a rising edge of the control signal and to close the controllable relay contact in the time-delayed manner in response to the identified rising edge in a switch-on operation.

10. The relay according to claim 1, wherein the controller is configured to identify a falling edge of the control signal and to open the controllable relay contact in the time-delayed manner in response to the identified falling edge in a switch-off operation.

11. The relay according to claim 1, wherein the controller is configured to close the controllable relay contact on the rising edge of the electrical variable and to open it again on the falling edge of the electrical variable to keep the controllable relay contact closed at the peak value of the electrical variable.

12. The relay according to claim 1, wherein the electrical connection terminal is an energy supply connection of the relay and wherein the electrical variable is a supply voltage, or wherein the electrical variable is a supply voltage in a switch-on operation and is a current in a switch-off operation.

13. A method for controlling a relay having a controllable relay contact, comprising:

tapping an electrical variable at an electrical connection terminal of the relay;

receiving a control signal for actuating the controllable relay contact at a control connection of the relay;

detecting a zero crossing of the electrical variable in response to the reception of the control signal;

determining a load behaviour of an electrical load;

determining a time delay for actuating the controllable relay contact based at least in part on the load behaviour;

actuating the controllable relay contact in a time-delayed manner after the zero crossing of the electrical variable and in accordance with the determined time delay; wherein the controllable relay contact is actuated in a load-dependent manner on a rising edge of the electrical variable, on a falling edge of the electrical variable, or at a peak value of the electrical variable; and detecting an arc voltage across the controllable relay contact in an open state in a switch-off operation of the relay; and closing the controllable relay contact in the switch-off operation of the relay when the arc voltage is detected;

wherein the load behaviour of the electrical load is determined by a type of the electrical load and specific current characteristics of the electrical load, wherein the type of the electrical load is one of: an ohmic load type, a lamp load type, a motor load type, a solenoid valves load type, or a capacitors load type, and wherein the specific current characteristics of the electrical load are determined from a ratio of switch-on current to continuous current associated with the corresponding type of the electrical load.

14. The method according to claim 13, further comprising:

actuating the controllable relay contact before a further zero crossing of the electrical variable.

15. The method according to claim 13, further comprising:

determining the time delay based at least in part on a reaction delay of the relay; or driving the controllable relay contact after a drive delay has expired.

16. The relay according to claim 1, wherein the controller is configured to actuate the controllable relay contact at a predetermined phase angle of the electrical variable after the zero crossing.

17. The method according to claim 13, wherein actuating the controllable relay contact is at a predetermined phase angle of the electrical variable after the zero crossing.

* * * * *